US011930855B2

(12) United States Patent
Qiu et al.

(10) Patent No.: US 11,930,855 B2
(45) Date of Patent: Mar. 19, 2024

(54) ELECTRONIC CIGARETTE

(71) Applicant: JOYETECH EUROPE HOLDING GMBH, Zug (CH)

(72) Inventors: Weihua Qiu, Changzhou (CN); Kui Liu, Changzhou (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 1481 days.

(21) Appl. No.: 16/171,072

(22) Filed: Oct. 25, 2018

(65) Prior Publication Data

US 2019/0133191 A1 May 9, 2019

(30) Foreign Application Priority Data

Oct. 25, 2017 (CN) ..... 201711006720.9
Oct. 25, 2017 (CN) ..... 201721387521.2

(51) Int. Cl.
*A24F 40/51* (2020.01)
*A24F 40/10* (2020.01)
*A24F 40/60* (2020.01)

(52) U.S. Cl.
CPC ..... *A24F 40/51* (2020.01); *A24F 40/60* (2020.01); *A24F 40/10* (2020.01)

(58) Field of Classification Search
CPC ..... A24F 40/51; A24F 40/50; A24F 40/60; A24F 40/10
USPC ..... 131/329
See application file for complete search history.

(56) References Cited

FOREIGN PATENT DOCUMENTS

| | | | | | |
|---|---|---|---|---|---|
| CN | 201393548 | Y | * | 2/2010 | ..... A24F 47/00 |
| CN | 203660013 | U | | 6/2014 | |
| CN | 104256898 | A | | 1/2015 | |
| CN | 105342017 | A | * | 2/2016 | ..... A24F 47/00 |
| CN | 10-2016-0044712 | A | | 4/2016 | |
| CN | 107205484 | A | | 4/2016 | |
| CN | 205214209 | U | | 5/2016 | |
| CN | 205358229 | U | | 7/2016 | |
| CN | 206005955 | U | | 3/2017 | |
| CN | 106778118 | A | | 5/2017 | |
| CN | 206303213 | U | | 7/2017 | |
| CN | 107205484 | A | | 9/2017 | |

(Continued)

OTHER PUBLICATIONS

CN201393548Y Machine Translation (Year: 2010).*

(Continued)

*Primary Examiner* — Michael J Felton
*Assistant Examiner* — Ronnie Kirby Jordan
(74) *Attorney, Agent, or Firm* — J.C. PATENTS

(57) ABSTRACT

The present disclosure discloses an electronic cigarette, a battery thereof is connected to an atomizing device through a first power supply circuit, the battery is connected to a first detecting device through a second power supply circuit, and first information detected by the first detecting device is used to indicate whether the electronic cigarette is in a suction state. The electronic cigarette further comprises a switching key, an on-off key, a second detecting device and an MCU, the on-off key is configured for controlling the first power supply circuit to be ON and OFF, and the second information detected by the second detecting device is used to indicate the position of the switching key; the MCU controls the second power supply circuit to be ON and OFF according to the second information.

9 Claims, 8 Drawing Sheets

(56) References Cited

FOREIGN PATENT DOCUMENTS

| | | | |
|---|---|---|---|
| CN | 207519619 | U | 6/2018 |
| CN | 109567273 | A | 4/2019 |
| DE | 102015103438 | A1 | 9/2016 |
| KR | 10-2016-0044712 | A | 4/2016 |

OTHER PUBLICATIONS

CN105342017A Machine Translation (Year: 2016).*
https://www.merriam-webster.com/dictionary/posture, Feb. 5, 2016, retrieved from Internet Archive Wayback Machine <https://web.archive.org/web/20160205112516/https://www.merriam-webster.com/dictionary/posture>, on Jul. 28, 2023 (Year: 2016).*
The third Office Action of CN application No. 201711006720.9.
The Chinese First Examination Report and Search Report of corresponding Chinese application No. 201711006720.9, dated Sep. 29, 2019.
The first Office Action of CN201710908024.0.

* cited by examiner

ELECTRONIC CIGARETTE

CROSS-REFERENCE TO RELATED APPLICATIONS

This application claims priorities to Chinese Patent Application No. 201721387521.2 filed on Oct. 25, 2017 and Chinese Patent Application No. 201711006720.9 filed on Oct. 25, 2017, both of which are hereby incorporated by reference in their entireties.

TECHNICAL FIELD

The present disclosure relates to the field of simulated smoking technologies and, in particular, to an electronic cigarette.

BACKGROUND

The electronic cigarette is an electronic product that imitates a cigarette. Smoke oil in a cartridge is heated by an atomizing device so that the smoke oil is atomized to generate smoke which can be inhaled by a user through a cigarette holder so as to achieve the purpose of simulating smoking.

Since the atomizing device of the electronic cigarette adopts heating principles of a heating wire, electric energy thereof is provided by a battery disposed in the electronic cigarette. The atomizing device needs to generate heat only when the electronic cigarette is used, and the power should be cut off at other times. Therefore, the electronic cigarette is usually provided with an on-off key, and the user manually lights up the cigarette by pressing the on-off key. At present, another electronic cigarette that is lighted up automatically is available in the market; the user directly sucks at the cigarette holder to trigger operation of the atomizing device in the electronic cigarette. However, there isn't an electronic cigarette product combining manual lighting with automatic lighting and could switch therebetween freely, the cigarette lighting method provided by each type of electronic cigarette in the market is single.

SUMMARY

In order to solve the problem that the cigarette lighting method provided by each type of electronic cigarette in the prior art is single, embodiments of the present disclosure provide an electronic cigarette and a control method thereof. The technical solution is as follows:

In a first aspect, an electronic cigarette is provided, including an atomizing device and a battery for supplying electrical energy to the atomizing device, the electronic cigarette further includes an on-off key, a control board, a shielding assembly, and a sensor electrically connected to the control board, when an operation signal satisfying a preset condition is received by the control board, the shielding assembly is controlled to switch between a first posture and a second posture;

when the shielding assembly is in the first posture, the sensor is in a failure state, and a circuit between the battery and the atomizing device is controlled to be ON and OFF by the control board according to an operation signal generated when the on-off key is operated;

when the shielding assembly is in the second posture, the operation signal generated when the on-off key is operated is not received by the control board, and the circuit between the battery and the atomizing device is controlled to be ON and OFF by the control board according to information detected by the sensor, where the information detected by the sensor is used to indicate whether the electronic cigarette is in a suction state.

Optionally, the shielding assembly is a shielding plate which is disposed between the sensor and the on-off key, and where the electronic cigarette further includes a motor mechanically connected to the shielding plate, and the motor is electrically connected to the control board;

when the operation signal satisfying the preset condition is received by the control board, the motor is controlled to rotate to drive the shielding plate to switch between the first posture and the second posture.

Optionally, the electronic cigarette further includes a cigarette holder and a connecting member, and the connecting member is provided with an air inlet passage in communication with the cigarette holder, when the shielding plate is in the second posture, the sensor is capable of detecting airflow within the air inlet passage.

Optionally, when the shielding plate is in the first posture, the shielding plate blocks all or part of air around the sensor from flowing in the air inlet passage.

Optionally, the shielding plate abuts against the on-off key when the shielding plate is in the second posture.

Optionally, the control board is further configured to control a circuit between the sensor and the battery to function as an open circuit and the shielding plate not to abut against the on-off key when the shielding plate is in the first posture; and the control board is further configured to control the circuit between the sensor and the battery to function as a close circuit and the shielding plate to abut against the on-off key when the shielding plate is in the second posture.

Optionally, the control board is further configured to control a circuit between the on-off key and the control board to function as a close circuit and the shielding plate to block all or part of air around the sensor from flowing in an air inlet passage when the shielding plate is in the first posture; and the control board is further configured to control the circuit between the on-off key and the control board to function as an open circuit and the shielding plate not to block air around the sensor from flowing in the air inlet passage when the shielding plate is in the second posture.

Optionally, the electronic cigarette further includes a switching key which is electrically connected to the control board and is disposed on a casing of the electronic cigarette, and the operation signal generated when the switching key is operated satisfies the preset condition.

Optionally, an indicator light is further disposed on a casing of the electronic cigarette, the control board is further configured to control the indicator light to light up in a first color when the shielding assembly is in the first posture.

Optionally, an indicator light is further disposed on a casing of the electronic cigarette, the control board is further configured to control the indicator light to light up in a second color or control the indicator light to be extinguished when the shielding assembly is in the second posture.

In a second aspect, a control method of an electronic cigarette is provided, and the control method of the electronic cigarette includes:

when a mode switching signal is received, switching between working modes of the electronic cigarette via software, where the working modes of the electronic cigarette include a manual mode or an automatic mode;

when the electronic cigarette is switched to the manual mode, controlling, according to an operation signal generated when an on-off key is operated, whether an atomizing device in the electronic cigarette works;

when the electronic cigarette is switched to the automatic mode, controlling, according to information detected by an airflow sensing device in the electronic cigarette, whether the atomizing device in the electronic cigarette works, where the information is used to indicate whether the electronic cigarette is in a suction state.

Optionally, the working modes of the electronic cigarette further include an integrated mode, and the control method of the electronic cigarette further includes:

when the electronic cigarette is switched to the integrated mode, controlling, according to the operation signal generated when the on-off key is operated or the information fed back by the airflow sensing device, whether the atomizing device in the electronic cigarette works.

Optionally, when the mode switching signal is received and a switch confirming condition is met, the step of switching between the working modes of the electronic cigarette via the software is performed.

Optionally, the switching between the working modes of the electronic cigarette includes:

if the electronic cigarette is in a first working mode, controlling the electronic cigarette to enter a second working mode after the mode switching signal is received, where the second working mode is different from the first working mode.

Optionally, the controlling the electronic cigarette to enter the second working mode includes:

determining the second working mode corresponding to the mode switching signal according to a preset correspondence relationship; and entering the determined second working mode;

where the preset correspondence relationship includes a switched working mode corresponding to the mode switching signal when the electronic cigarette is in different working modes, or the preset correspondence relationship includes a switched working mode corresponding to different mode switching signals.

Optionally, the method further includes:

providing indication information corresponding to the second working mode after the mode switching signal is received.

Optionally, the control method of the electronic cigarette further includes:

when the electronic cigarette is in the manual mode, controlling a circuit between the airflow sensing device and the battery to function as an open circuit; and when the electronic cigarette is in the automatic mode, controlling the circuit between the airflow sensing device and the battery to function as a close circuit.

Optionally, the electronic cigarette further includes a voice sensor, and the switching between the working modes of the electronic cigarette includes:

controlling a voice sensor to collect a voice signal within a predetermined time; and switching between the working modes of the electronic cigarette according to the voice signal.

Optionally, the electronic cigarette further includes a gyroscope, and the switching between the working modes of the electronic cigarette includes:

detecting a movement track of the electronic cigarette within a predetermined time using a gyroscope; and switching between the working modes of the electronic cigarette according to the movement track.

In a third aspect, a computer readable storage medium is provided, one or more instructions are stored in the computer readable storage medium, the control method of the electronic cigarette according to the second aspect and any optional implementation of the second aspect is achieved when the one or more instructions are executed by a processor in the electronic cigarette.

In a fourth aspect, a control device of an electronic cigarette is provided, characterized in that the device includes:

a processor; and a memory for storing an executable instruction of the processor;

where the processor performs the control method of the electronic cigarette according to the fifth aspect and any optional implementation of the fifth aspect by executing the instruction.

Beneficial effects brought by the technical solution provided in the embodiments of the present disclosure are:

By providing a shielding assembly, a sensor and an on-off key in an electronic cigarette, when an operation signal satisfying a preset condition is received by a control board, the shielding assembly is controlled to switch between a first posture and a second posture. Since when the shielding assembly is in the first posture, the sensor is in a failure state, and a circuit between a battery and an atomizing device is controlled to be ON and OFF by the control board according to the operation signal generated when the on-off key is operated, so that a user can light up the cigarette by operating the on-off key, but cannot light up the cigarette by sucking at a cigarette holder. When the shielding assembly is in the second posture, the operation signal generated when the on-off key is operated is not received by the control board, the circuit between the battery and the atomizing device is controlled to be ON and OFF by the control board according to information detected by the sensor, where the information detected by the sensor is used to indicate whether the electronic cigarette is in a suction state, so that the user can light up the cigarette by sucking at the cigarette holder, but cannot light up the cigarette by operating the on-off key. The problem is solved with regard to the aspect that the cigarette lighting method provided by the electronic cigarette in the related art is single, and the effect is achieved with regard to enrichment of the cigarette lighting method provided by the electronic cigarette.

BRIEF DESCRIPTION OF DRAWINGS

In order to more clearly illustrate the technical solution in the embodiments of the present disclosure, the drawings used in the description of the embodiments will be briefly described below. It is obvious that the drawings in the following description are only some examples of the present disclosure. For those skilled in the art, other drawings can be obtained according to these drawings without any creative effort.

DETAILED DESCRIPTION

Figure 1:
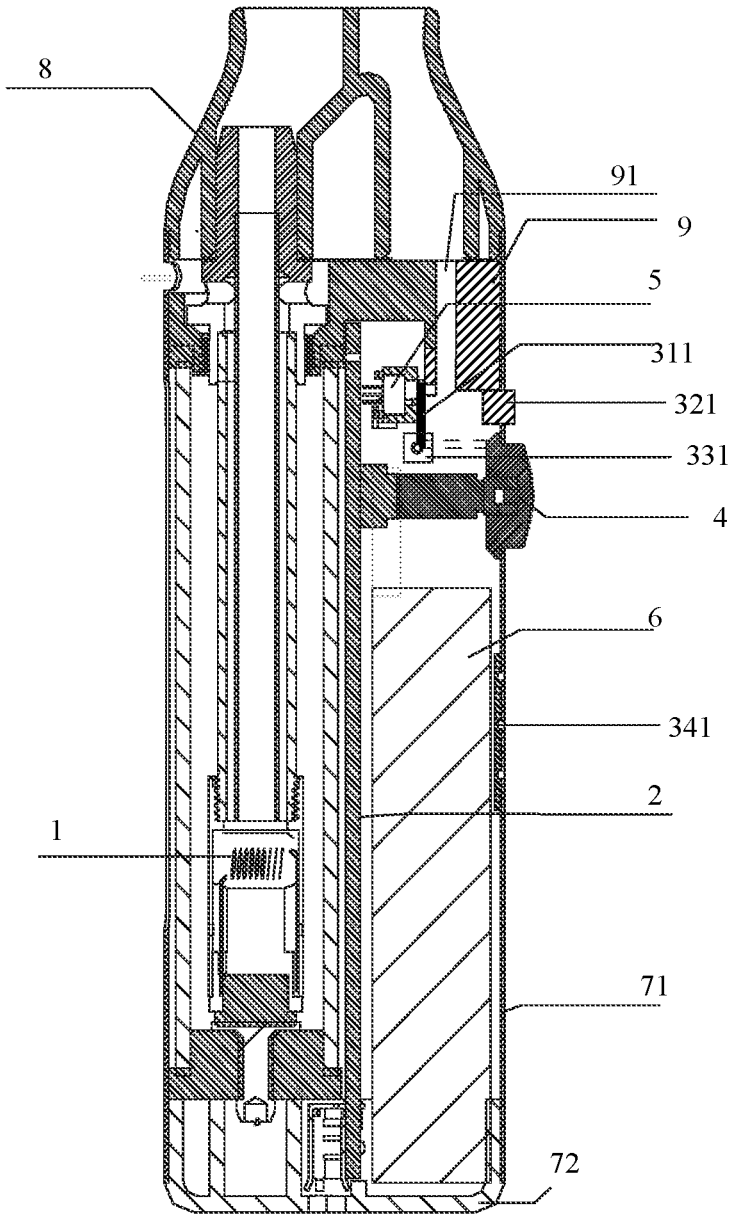
FIG. 1 is a structural schematic diagram of an electronic cigarette according to the present disclosure.

In order to describe objectives, the technical solution and advantages of the present disclosure more clearly, the embodiments of the present disclosure will be further described in detail below with reference to the accompanying drawings.

For names and reference numerals of the components in the drawings, please see Table 1. Table 1 is shown as follows:

| | | | |
|---|---|---|---|
| atomizing device: 1 | control board: 2 | airflow sensing device: 15 | on-off key: 4 |
| battery: 6 | cigarette holder: 8 | connecting member: 9 | air passage: 31 |
| sensor: 5 | casing: 71 | bottom cap: 72 | airflow passage: 91 |
| shielding plate: 311 | switching key: 321 | motor: 331 | display screen: 51 |

Reference may be made to FIG. 1, where an electronic cigarette provided in the present disclosure includes an atomizing device 1, a control board 2, and a battery 6 for supplying electric energy to the atomizing device 1. An electronic switch is provided in a circuit between the battery 6 and the atomizing device 1, and the control end of the electronic switch is connected to the control board 2. The control board 2 controls the circuit between the battery 6 and the atomizing device 1 to be ON and OFF by controlling the electronic switch to be ON and OFF.

Reference may be still made to FIG. 1, where the electronic cigarette further includes an on-off key 4 which is limited between the control board 2 and a casing 71 and is formed by connecting a pressing portion and a base. Optionally, a portion of the pressing portion is inside the casing 71, and another portion of the pressing portion is outside the casing 71 for a user to operate, and the base is inside the casing 71 and connected to the control board 2.

The on-off key 4 can be used to control the circuit between the battery 6 and the atomizing device 1 to be ON and OFF. The on-off key 4 can be any one of a touch button, a touch screen, and a pressure button, and the on-off key 4 is electrically connected to the control board 2. Description is made by taking an example where the on-off key 4 is the pressure button and the user manually lights up a cigarette by pressing the on-off key, when the control board 2 receives an operation signal generated when the on-off key 4 is pressed, the control board 2 may control the above electronic switch to be off, enabling the battery 6 to supply electric energy to the atomizing device 1, so that the user can manually light up cigarette by pressing the on-off key 4.

Reference may be still made to FIG. 1, where the electronic cigarette further includes a sensor 5, a cigarette holder 8, and an air inlet passage 91. The cigarette holder 8 is in communication with the air inlet passage 91, and the sensor 5 is disposed in the air inlet passage 91. The sensor 5 may be a sensor such as a pressure sensor, a barometric sensor, an air flow sensor or the like, which can be used to detect airflow, and the type of the sensor 5 is not limited in the present embodiment.

Since the sensor 5 is disposed in the air inlet passage 91, when the user sucks at the cigarette holder 8, air around the sensor 5 flows accordingly, that is, information detected by the sensor 5 changes. Therefore, the information detected by the sensor 5 may be used to indicate whether the user sucks at the cigarette holder 8 (if the flow rate of the detected airflow exceeds a preset threshold, then the user is sucking, whereas if the flow rate does not exceed the preset threshold, the user is not sucking).

In this embodiment, the sensor 5 is electrically connected to the control board 2. The sensor 5 may report information collected by the sensor 5 to the control board 2, and the control board 2 controls the circuit between the battery 6 and the atomizing device 1 to be ON and OFF according to the information. Therefore, when the user sucks at the cigarette holder 8, automatic cigarette lighting may be achieved.

The detailed solution used in this embodiment will be disclosed below. Specifically, the electronic cigarette disclosed in this embodiment includes a casing 71 with a bottom cover 72 provided at the bottom of the casing 71, where the casing 71 and the bottom cover 72 are connected under an interference fit. The atomizing device 1, the control board 2, the battery 6, and the sensor 5 described above are all disposed in the casing 71.

A connecting member 9 is disposed at the upper end of the casing 71, and the cigarette holder 8 is connected to the connecting member 9. The connecting member 9 and the casing 71 are also fixedly connected under an interference fit, and a pluggable detachable connection is used between the cigarette holder 8 and the connecting member 9. Further, the control board 2 is disposed in the middle of the casing 71, and the atomizing device 1 and the battery 6 are disposed at both sides of the control board 2, respectively.

As an optional embodiment, in the electronic cigarette of the present embodiment, an air inlet passage 91 in communication with the cigarette holder 8 is disposed on the connecting member 9, and the sensor 5 is disposed at the upper end of the control board 2 close to the air inlet passage 91 on the connecting member 9.

When the control board 2 receives an operation signal satisfying a preset condition, switching between working modes of the electronic cigarette is performed, where the working modes of the electronic cigarette includes a manual mode and an automatic mode. This embodiment is described by taking an example where a switching key 321 is also disposed on the casing 71 of the electronic cigarette and the operation signal generated when the switching key 321 is operated satisfies the preset condition. The switching between the working modes of the electronic cigarette is performed when the control board 2 receives the operation signal generated when the switching key 321 is operated.

Optionally, as shown in FIG. 1, the switching key 321 is disposed on the casing 71 and located between the connecting member 9 and the on-off key 4. The switching key 321 may be any one of a touch button, a touch screen, and a pressure button.

This embodiment is described by taking an example where the switching key 321 is a pressure button to illustrate how the user switches between the working modes of the electronic cigarette. Generally, in the case that the electronic cigarette operates in the manual mode, the user may press the switching key 321 to enable the electronic cigarette to enter the automatic mode; in the case that the electronic cigarette operates in the automatic mode, the user may press the switching key 321 to enable the electronic cigarette to enter the manual mode.

In the case that the electronic cigarette is in the manual mode, the user may manually light up a cigarette by operating the on-off key 4; in the case that the electronic cigarette is in the automatic mode, the user may automatically light up a cigarette by sucking at the cigarette holder 8.

In this embodiment, the electronic cigarette further includes a shielding assembly. After receiving the operation signal satisfying the preset condition, the control board 2 controls the shielding assembly to switch between a first posture and a second posture.

It should be noted that when the shielding assembly is in the first posture, the electronic cigarette is in the manual mode, where the sensor 5 is in a failure state, the circuit between the battery 6 and the atomizing device 1 is controlled to be ON and OFF by the control board 2 according to the operation signal generated when the on-off key 4 is operated, and the sensor 5 in the failure state stops detecting or continuously detects information indicating that the electronic cigarette is not in the suction state; when the shielding assembly is in the second posture, the electronic cigarette is in the automatic mode, where the control board 2 does not receive the operation signal generated when the on-off key 4 is operated, the circuit between the battery 6 and the atomizing device 1 is controlled to be ON and OFF by the control board 2 according to the information detected by the sensor 5, and the information detected by the sensor 5 is used to indicate whether the electronic cigarette is in the suction state.

As an optional embodiment, as shown in FIG. 1, the shielding assembly is a shielding plate 311, and the electronic cigarette further includes a motor 331 mechanically connected to the shielding plate 311. The motor 331 is electrically connected to the control board 2, the sensor 5 is above the on-off key 4, and the motor 331 and the shielding plate 311 are disposed between the sensor 5 and the on-off key 4. Specifically, a rotating shaft (not shown in the drawing) of the shielding plate 311 is mechanically connected to a rotor (not shown in the drawing) of the motor 331.

Optionally, the rotating shaft of the shielding plate 311 is located at one end of the shielding plate 311 and is mechanically connected to the rotor of the motor 331. The control board 2 controls the rotation of the motor 331 to drive the shielding plate 311 to rotate, causing the shielding plate 311 to switch between the first posture and the second posture.

The following three cases are separately explained.

Case 1: as shown in FIG. 1, the shielding plate 311 in the first posture shields the sensor 5 and does not abut against the on-off key 4, the shielding plate 311 then blocks all or part of air around the sensor 5 from flowing in the air inlet passage 91, causing the sensor 5 to fail. At this point, even if the user sucks at the cigarette holder 8, there is no change or only a small amount of change in data detected by the sensor 5, the information detected by the sensor 5 indicates that the electronic cigarette is not in the suction state, rendering that the control board 2 cannot control the circuit between the atomizing device 1 and the battery 6 to function as a close circuit. It can be seen that the user then cannot realize automatic cigarette lighting by sucking at the cigarette holder 8. In order to enable the user to manually light up the cigarette by pressing the on-off key 4, when the shielding plate 311 is in the first posture, the circuit between the battery 6 and the atomizing device 1 is controlled to be ON and OFF by the control board 2 according to the operation signal generated when the on-off key 4 is operated.

Figure 2:
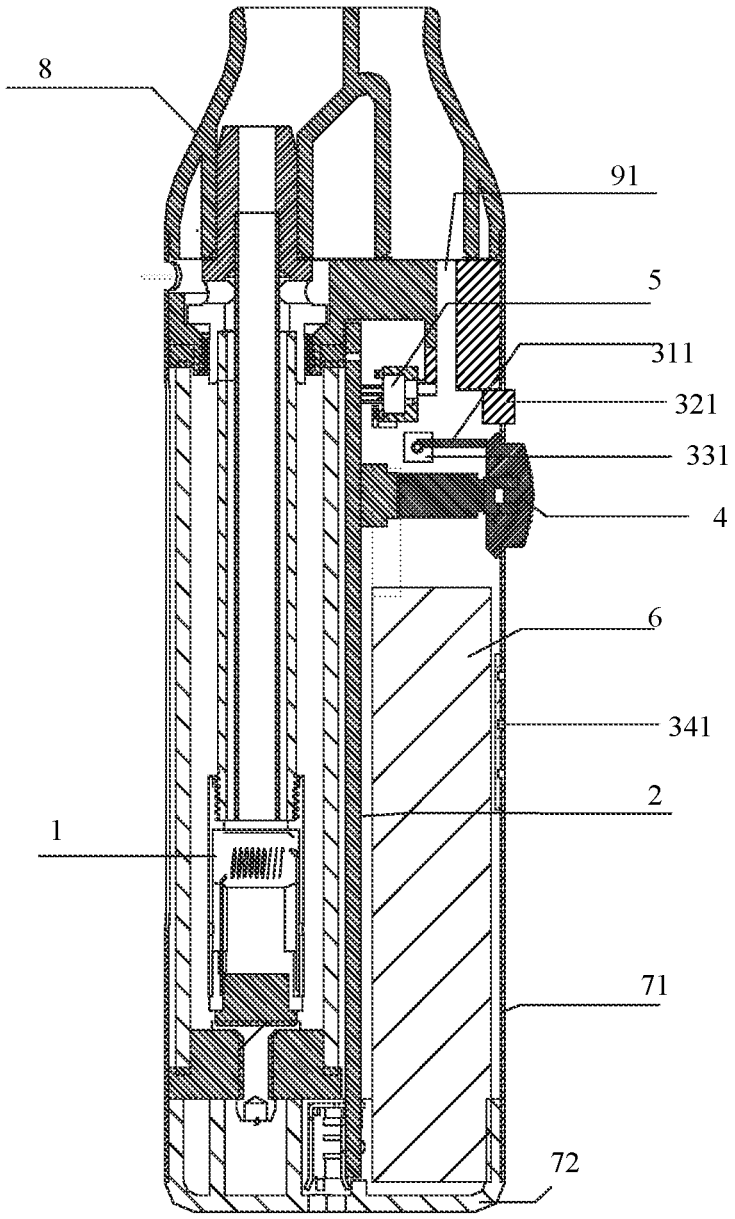
FIG. 2 is a schematic diagram of an electronic cigarette in an automatic mode according to the present disclosure.

The shielding plate 311 in the second posture abuts against the on-off key 4 and does not shield the sensor 5, as shown in FIG. 2, the shielding plate 311 in the second posture abuts against a pressing portion of the on-off key 4. At this time, the on-off key 4 cannot be pressed due to the abutment from the shielding plate 311, thus the user cannot manually light up the cigarette by pressing the on-off key 4. As shown in FIG. 2, the shielding plate 311 in the second posture does not shield the sensor 5 either, and then the information detected by the sensor 5 is used to indicate whether the electronic cigarette is in the suction state, the control board 2 controls the circuit between the battery 6 and the atomizing device 1 to be ON and OFF according to the information detected by the sensor 5, and the electronic cigarette is in the automatic mode.

As an optional embodiment, the shielding plate 311 in the first posture closes a sensitive element of the sensor 5.

As an optional embodiment, the shielding plate 311 in the first posture is completely attached to the sensitive element of the sensor 5.

Case 2: the shielding plate 311 in the first posture does not shield the sensor 5 and does not abut against the on-off key 4, at which time the control board 2 controls the circuit between the battery 6 and the sensor 5 to function as an open circuit to stop the detection from the sensor 5, that is, causing the sensor 5 to fail. The control board 2 controls the circuit between the battery 6 and the atomizing device 1 to be ON and OFF according to the operation signal generated when the on-off key 4 is operated, and the electronic cigarette is in the manual mode.

The shielding plate 311 in the second posture does not shield the sensor 5 and abuts against the on-off key 4, so that the user cannot operate the on-off key 4, rendering that the control board 2 cannot receive the operation signal generated when the on-off key 4 is operated. At this time, the control board 2 controls the circuit between the battery 6 and the sensor 5 to function as a close circuit, and controls the circuit between the battery 6 and the atomizing device 1 to be ON and OFF according to the information detected by the sensor 5; and the electronic cigarette is in the automatic mode.

Case 3: as shown in FIG. 1, the shielding plate 311 in the first posture shields the sensor 5 and does not abut against the on-off key 4, causing the sensor 5 to fail. The control board 2 controls a circuit between the on-off key 4 and the control board 2 to function as a close circuit, and then controls the circuit between the battery 6 and the atomizing device 1 to be ON and OFF according to the operation signal generated when the on-off key 4 is operated; and the electronic cigarette is in the manual mode.

The shielding plate 311 in the second posture does not shield the sensor 5, and can abut against the on-off key 4 or cannot abut against the on-off key 4. The circuit between the on-off key 4 and the control board 2 is controlled by the control board 2 to function as an open circuit, so that the control board 2 cannot receive the operation signal generated when the on-off key 4 is operated. Since the shielding plate 311 does not shield the sensor 5, the information detected by the sensor 5 is used to indicate whether the electronic cigarette is in the suction state. At this time, the control board 2 controls the circuit between the battery 6 and the atomizing device 1 to be ON and OFF according to the information detected by the sensor 5, and the electronic cigarette is in the automatic mode.

Specifically, an electronic switch is disposed in the circuit between the on-off key 4 and the control board 2, and the control end of the electronic switch is connected to the control board 2. The control board 2 controls the electronic switch between the control board 2 and the on-off key 4 to be OFF when the shielding plate 311 is in the second posture. It should be noted that when the shielding plate 311 is in the first posture, the control board 2 controls the electronic switch to be ON to ensure that the control board 2 can receive the operation signal generated when the on-off key 4 is operated.

As an operational embodiment, the shielding plate 311 in the first posture closes a sensitive element of the sensor 5. As an optional embodiment, the shielding plate 311 in the first posture is completely attached to the sensitive element of the sensor 5.

As an optional embodiment, an indicator light (not shown in the drawing) is disposed on the casing 71 of the electronic cigarette, which is electrically connected to the control board 2 for indicating the working mode of the electronic cigarette.

For example, in the case that the electronic cigarette is in the automatic mode, the control board 2 may control the indicator light to light up in a first color; in the case that the electronic cigarette is in the manual mode, the control board 2 may control the indicator light to light up in a second color. The first color and the second color are different colors. For example, the first color may be green, while the second color may be yellow.

For another example, in the case that the electronic cigarette is in the automatic mode, the control board 2 may control the indicator light to light up in the first color; in the case that the electronic cigarette is in the manual mode, the control board 2 may control the indicator light to extinguish.

It should be noted that, the above description is only made by taking an example where the shielding plate 311, when in the first posture and the second posture, is in the above arrangement so that the on-off key and the sensor satisfy requirements. In an actual implementation, the shielding plate 311 may also make the on-off key and the sensor meet the requirements through other ways, and details will be omitted herein.

According to the electronic cigarette provided in this embodiment, by proving the shielding assembly, the sensor 5 and the on-off key 4 in the electronic cigarette, the control board 2 controls the shielding assembly to switch between the first posture and the second posture when receiving the operation signal satisfying the preset condition. Since when the shielding assembly is in the first posture, the sensor 5 is in a failure state, and the control board 2 controls the circuit between the battery 6 and the atomizing device 1 to be ON and OFF according to the operation signal generated when the on-off key 4 is operated, so that the user can light up the cigarette by operating the on-off key 4, but cannot light up the cigarette by sucking at the cigarette holder 8. When the shielding assembly is in the second posture, the control board 2 does not receive the operation signal generated when the on-off key 4 is operated, the circuit between the battery 6 and the atomizing device 1 is controlled to be ON and OFF by the control board 2 according to information detected by the sensor 5, where the information detected by the sensor 5 is used to indicate whether the electronic cigarette is in the suction state, so that the user can light up the cigarette by sucking at the cigarette holder 8, but cannot light up the cigarette by operating the on-off key 4. The problem is solved with regard to the aspect that the cigarette lighting method provided by the electronic cigarette in the related art is single, and the effect is achieved with regard to enrichment of the cigarette lighting method provided by the electronic cigarette.

Figure 3:
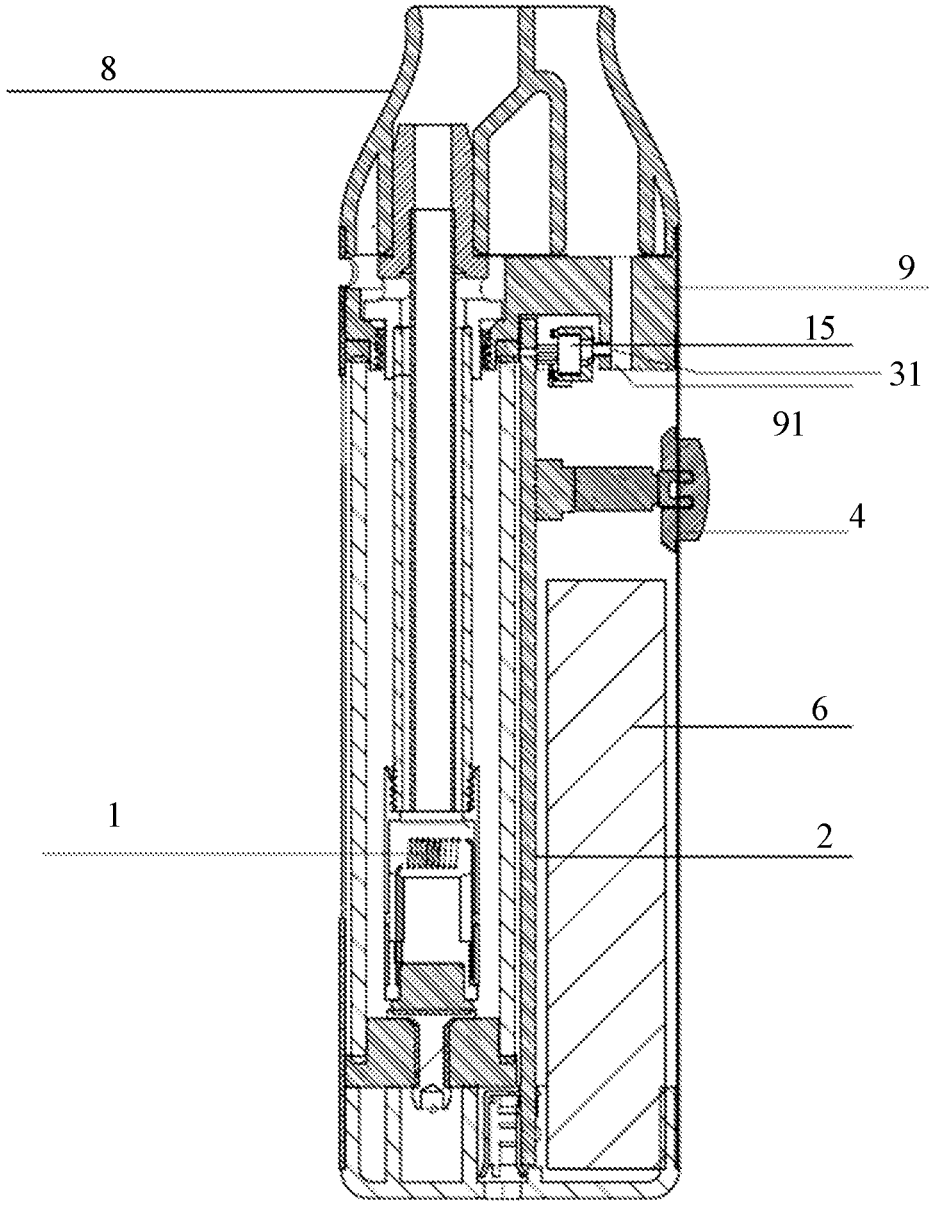
FIG. 3 is a structural schematic diagram of an electronic cigarette according to an embodiment of the present disclosure.

Reference may be made to FIG. 3 which shows a structural schematic diagram of an electronic cigarette provided in an embodiment of the present disclosure. As shown in FIG. 3, the electronic cigarette includes a cigarette holder 8, an atomizing device 1, a battery 6, an airflow sensing device 15, and a control board 2. Optionally, the cigarette holder 8, the atomizing device 1, the battery 6, the airflow sensing device 15 and the control board 2 are all disposed inside the electronic cigarette. The control board 2 is disposed in the middle of the electronic cigarette, the atomizing device 1 and the battery 6 are disposed on both sides of the control board 2, respectively, and the cigarette holder 8 is disposed at one end of the electronic cigarette.

The atomizing device 1 is used for atomizing smoke liquid or smoke cartridge in the electronic cigarette, the battery 6 is used for supplying power to the atomizing device 1 and the airflow sensing device 15, and the airflow sensing device 15 is used for detecting a suction behavior of the user.

Optionally, as shown in FIG. 3, a connecting member 9 is provided at the upper end of the casing of the electronic cigarette, and the connecting member 9 and the casing are connected under an interference fit. The connecting member 9 is provided with an airflow passage 91, and the cigarette holder 8 is in communication with the airflow passage 91. An air passage 31 on the airflow sensing device 15 is in communication with the airflow passage 91.

The cigarette holder 8 of the electronic cigarette is connected to the connecting member 9, and a pluggable detachable connection is used between the cigarette holder 8 and the connecting member 9; the airflow sensing device 15 may be a sensor for sensing airflow, such as a barometric sensor, an airflow sensor, a pressure sensor and the like; the airflow sensing device 15 may also be a device that converts a sound signal into an electrical signal.

When the user sucks at the cigarette holder 8, airflow is generated in the airflow passage 91 in communication with the cigarette holder 8 and in the air passage 31 on the sensor, causing the data detected by the airflow sensing device 15 to change. Therefore, the information detected by the airflow sensing device 15 may be used to indicate whether the electronic cigarette is in the suction state.

The electronic cigarette further includes an on-off key 4 and a control board 2, where a processor (not shown in FIG. 3) is disposed on the control board 2. The on-off key 4 may be any one of a touch button, a touch screen, and a pressure button. This embodiment is described by taking an example where the on-off key 4 is the pressure button. See FIG. 3 for details.

Figure 4:
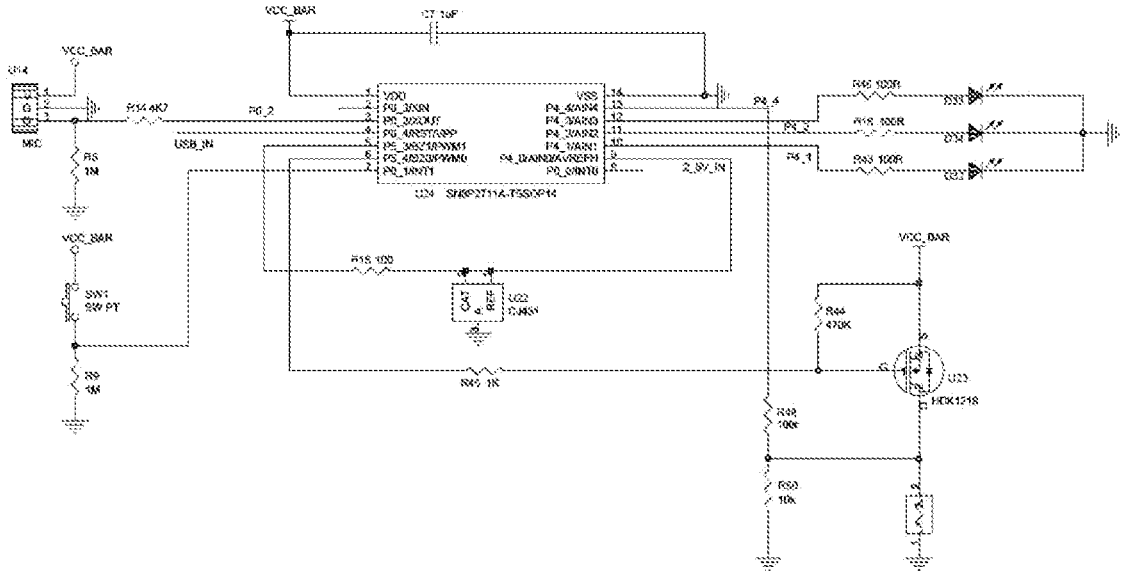
FIG. 4 is a schematic diagram showing a connection relationship between components in an electronic cigarette according to an embodiment of the present disclosure.

See FIG. 4 for a connection relationship between components in the electronic cigarette. As shown in FIG. 4, the processor (named U22 in the circuit shown in FIG. 4) is electrically connected to the on-off key (named SW1 in FIG. 4) and the airflow sensing device (named U9 in FIG. 4), respectively. The processor is also electrically connected to the base electrode of a first power switch (named U23 in FIG. 4), and the source electrode of the first power switch is electrically connected to a power source, and the grid electrode of the first power switch is electrically connected to the atomizing device.

It should be noted that the component named U9 shown in FIG. 4 is a microphone. If the airflow sensing device in this embodiment is a sensor, then the data terminal of the airflow sensing device in the electronic cigarette is electrically connected to the processor, so that the processor acquires the data detected by the sensor.

Optionally, the electronic cigarette may further include a first indicator light and a second indicator light, where the first indicator light and the second indicator light are respectively electrically connected to the processor. For example, as shown in FIG. 4, the first indicator light (named D33 in FIG. 4) is electrically connected to the processor, and the second indicator light (named D34 in FIG. 4) is electrically connected to the processor.

The color when the first indicator light is lit is different from the color when the second indicator light is lit. For example, the first indicator light may be an orange indicator light and the second indicator light may be a green indicator light.

Optionally, the electronic cigarette may further include a third indicator light, where the third indicator light is electrically connected to the processor. For example, as shown in FIG. 4, the third indicator light (named D32 in FIG. 4) is electrically connected to the processor. The color when the third indicator light is lit is different from the color when the first indicator light is lit and the color when the second indicator light is lit. For example, the third indicator light may be a red indicator light and the third indicator light is red when it is to lit.

Optionally, any one or more of the first indicator light, the second indicator light and the third indicator light may be a light emitting diode (Light Emitting Diode, LED) lamp.

Optionally, a display screen (not shown in FIG. 3) may be disposed on the casing of the electronic cigarette, and the display screen is connected to the processor.

Optionally, a voice sensor is disposed inside the electronic cigarette, and the voice sensor is connected to the processor.

Optionally, a gyroscope is disposed inside the electronic cigarette, and the gyroscope is connected to the processor.

Figure 5:
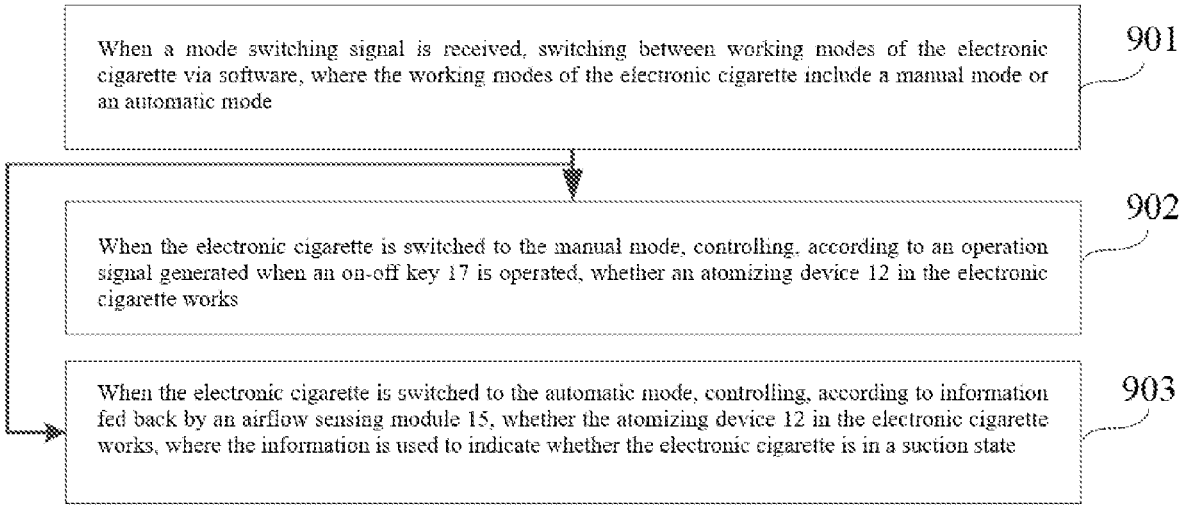
FIG. 5 is a flowchart of a control method of an electronic cigarette according to an embodiment of the present disclosure.

Reference may be made to FIG. 5 which shows a flowchart of a control method of an electronic cigarette according to an embodiment of the present disclosure. The method may be applied to the electronic cigarette as shown in FIG. 3 or to the processor of the electronic cigarette as shown in FIG. 4. As shown in FIG. 5, the control method may include:

Step 901: when a mode switching signal is received, switching between working modes of the electronic cigarette via software, where the working modes of the electronic cigarette include a manual mode or an automatic mode.

Step 902, when the electronic cigarette is switched to the manual mode, controlling, according to an operation signal generated when an on-off key 4 is operated, whether an atomizing device 1 in the electronic cigarette works.

Step 903, when the electronic cigarette is switched to the automatic mode, controlling, according to information fed back by an airflow sensing device 15, whether the atomizing device 1 in the electronic cigarette works, where the information is used to indicate whether the electronic cigarette is in a suction state.

In conclusion, according to the control method of the electronic cigarette provided in this embodiment, by means of switching between working modes of the electronic cigarette via software when a mode switching signal is received by the electronic cigarette; when the electronic cigarette is switched to the manual mode, controlling, according to an operation signal generated when an on-off key 4 is operated, whether the atomizing device 1 in the electronic cigarette works; and when the electronic cigarette is switched to the automatic mode, controlling, according to information detected by the airflow sensing device 15 in the electronic cigarette, whether the atomizing device 1 in the electronic cigarette works, the problem is solved with regard to the aspect that the cigarette lighting method provided by each type of electronic cigarette in the market is single and the effect is achieved with regard to enrichment of the cigarette lighting method provided by the electronic cigarette.

Figure 6:
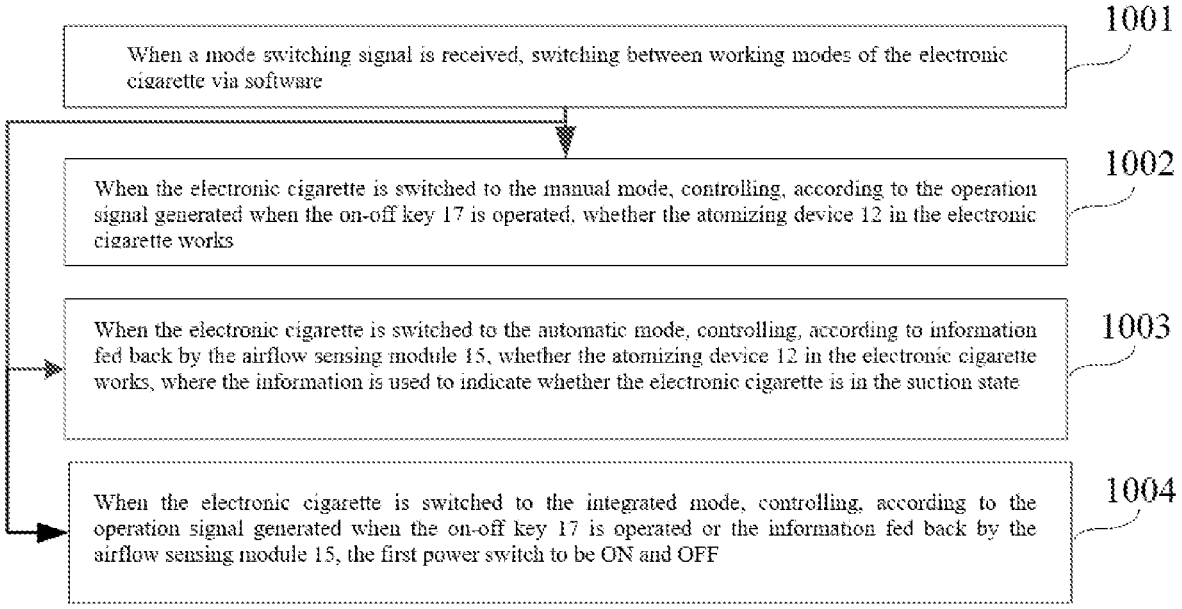
FIG. 6 is a flowchart of a control method of an electronic cigarette according to another embodiment of the present disclosure.

Reference may be made to FIG. 6 which shows a flowchart of a control method of an electronic cigarette according to another embodiment of the present disclosure. The method may be applied to the electronic cigarette as shown in FIG. 3 or to the processor of the electronic cigarette as shown in FIG. 4. As shown in FIG. 6, the control method may include:

Step 1001: when a mode switching signal is received, switching between working modes of the electronic cigarette via software.

Working modes of the electronic cigarette may include an automatic mode, a manual mode, and an integrated mode. When the electronic cigarette is in the manual mode, the user may control the atomizing device 1 in the electronic cigarette to work by operating the on-off key 4; when the electronic cigarette is in the automatic mode, the user may control the atomizing device 1 in the electronic cigarette to work by sucking at the cigarette holder 8; when the electronic cigarette is in the integrated mode, the user may trigger the atomizing device 1 in the electronic cigarette to work by sucking at the cigarette holder 8 or operating the on-off key 4.

A developer may preset at least one mode switching signal, and the mode switching signal is not specifically limited in this embodiment. For example, an operation signal generated when the on-off key 4 on the electronic cigarette is operated with an operation may be set as a mode switching signal. For another example, in the case that a switching key is provided on the electronic cigarette, an operation signal generated when the switching key is operated with an operation may be set as a mode switching signal, and the switching key may be any one of a touch button, a touch screen, and a pressure button. For another example, in the case that a display screen is provided on the electronic cigarette, the display screen may display an icon corresponding to each working mode, the mode switching signal may be a signal generated when an icon corresponding to any working mode is selected by the user. For another example, a switching key is provided on the electronic cigarette for each working mode separately, and an operation signal generated when a switching key corresponding to each working mode is operated may be a mode switching signal.

Description is made by taking an example where the on-off key 4 is a pressure button and a mode switching signal is preset for the electronic cigarette. The mode switching signal may be an operation signal generated when the on-off key 4 is continuously pressed for a preset duration, and the mode switching signal may be a plurality of operation signals generated when the on-off key 4 is pressed for a preset number of times within a preset duration.

Description is made by taking another example where the on-off key 4 is a touch screen and a mode switching signal is preset for an electronic cigarette. The mode switching signal may be a touch signal generated when the touch screen is continuously touched for a preset duration, and the mode switching signal may be a plurality of touch signals generated when the touch screen is touched for a preset number of times within a preset duration.

Description is made by taking another example where the switching key is a pressure button. The developer presets three mode switching signals for the electronic cigarette, the three mode switching signals are respectively: 1. an operation signal generated when the switching key is continuously pressed for a first duration, where the first duration is less than or equal to 1 s; 2. an operation signal generated when the switching key is continuously pressed for a second duration, where the second duration is more than is and less than 3 s; 3. an operation signal generated when the switching key is continuously pressed for a third duration, where the third duration is more than or equal to 3 s.

In an actual implementation, the on-off key 4 may be any one of a touch button, a touch screen, and a pressure button. A technician may set at least one mode switching signal with reference to the type of the on-off key 4 actually used in the electronic cigarette, or set at least one mode switching signal with reference to the type of the switching key on the electronic cigarette, and details will be omitted herein.

In this step, the switching between the working modes of the electronic cigarette via the software may be realized by any one of Embodiment 1, Embodiment 2 and Embodiment 3 illustrated below. Moreover, the switching between the working modes of the electronic cigarette via the software described in this embodiment refers to the control of the switching between the working modes via a program without changing hardware structures in the electronic cigarette.

Embodiment 1: After the mode switching signal is received, controlling the electronic cigarette to enter a second working mode different from a first working mode which is a working mode when the electronic cigarette receives the mode switching signal.

The controlling the electronic cigarette to enter the second working mode may be implemented by two implementations as follow:

The first one: determining the second working mode corresponding to the mode switching signal according to a preset correspondence relationship, where the preset correspondence relationship described herein includes a switched working mode corresponding to the mode switching signal when the electronic cigarette is in different working modes; and entering the determined second working mode.

It should be noted that a switched working mode corresponding to the mode switching signal in each working mode is different from the described each working mode.

Optionally, switched working modes corresponding to the mode switching signal respectively in any two working modes are different. For example, the preset correspondence is shown in Table 2, when in the manual mode, the electronic cigarette enters the automatic mode after receiving the mode switching signal; when in the automatic mode, the electronic cigarette enters the integrated mode after receiving the mode switching signal; and when in the integrated mode, the electronic cigarette enters the manual mode after receiving the mode switching signal.

TABLE 2

| First working mode | Switched working mode |
|---|---|
| Manual mode | Automatic mode |
| Automatic mode | Integrated mode |
| Integrated mode | Manual mode |

The second one: determining the second working mode corresponding to the mode switching signal according to the preset correspondence relationship, where the preset correspondence relationship described herein includes a switched working mode corresponding to different mode switching signals; and entering the determined second working mode.

Description is made by taking an example where a switching key is provided on the electronic cigarette. The switch key is electrically connected to the processor in the electronic cigarette. A technician may set an operation signal generated when the switching key is continuously pressed for a first duration as a first mode switching signal, where the first duration is less than or equal to 1 s, and the first mode switching signal corresponds to the manual mode; the technician may also set an operation signal generated when the switching key is continuously pressed for a second duration as a second mode switching signal, where the second duration is more than is and less than 3 s, and the second mode switching signal corresponds to the automatic mode; the technician may also set an operation signal generated when the switching key of the electronic cigarette is continuously pressed for a third duration as a third mode switching signal, where the third duration is more than 3 s, and the third mode switching signal corresponds to the integrated mode.

Description is made by taking an example where a display screen is provided on the electronic cigarette. An icon corresponding to each working mode may be displayed on the display screen; for the electronic cigarette, the manual mode is determined as the second working mode and the manual mode is entered in the case that the mode switching signal received by the electronic cigarette is a signal generated when the icon corresponding to the manual mode is selected by the user in the display screen; and for the electronic cigarette, the automatic mode is determined as the second working mode and the automatic mode is entered in the case that the mode switching signal received by the electronic cigarette is a signal generated when the icon corresponding to the automatic mode is selected by the user.

Optionally, in this step, after the mode switching signal is received, the electronic cigarette further provides indication information corresponding to the second working mode, where the indication information is used to prompt the user that the electronic cigarette enters the second working mode.

It should be noted that the execution order of "providing indication information corresponding to the second working mode" and "controlling the electronic cigarette to enter the second working mode" is not limited in this embodiment. In an actual implementation, they can be executed at the same time; or "providing indication information corresponding to the second working mode" may be executed first, and then "controlling the electronic cigarette to enter the second working mode" is executed; or "controlling the electronic cigarette to enter the second working mode" may be executed first, and then "providing indication information corresponding to the second working mode" is executed.

Embodiment 2: A voice sensor is also disposed in the electronic cigarette. When the mode switching signal is received by the electronic cigarette, the voice sensor is controlled to collect a voice signal within a predetermined time and switching is performed between the working modes of the electronic cigarette according to the voice signal.

Specifically, the technician presets a voice password for each working mode of the electronic cigarette. For example, the voice password set by the technician for the automatic mode may be a voice password such as automatic, automatic mode, 1, and the like; the voice password set for the manual mode may be a voice password such as manual, manual mode, 2, and the like; the voice password set for the integrated mode may be a voice password such as integrated, integrated mode, 2, and the like.

Description is made by taking an example where the voice password corresponding to the automatic mode is automatic, the voice password corresponding to the manual mode is manual, and the voice password corresponding to the integrated mode is integrated. The user enables the generated operation signal to be a mode switching signal by operating the on-off key 4, and enables the electronic cigarette to collect a voice signal with the voice sensor within a predetermined time by speaking words such as the automatic mode to the electronic cigarette, where the collected voice signal includes the voice password said by the user; voice content corresponding to the voice signal is recognized after the voice signal is acquired. If the voice content includes automatic, then the electronic cigarette enters the automatic mode; if the voice content includes manual, then the electronic cigarette enters the manual mode; if the voice content includes integrated, then the electronic cigarette enters the integrated mode.

Optionally, the working mode switched according to the voice signal is determined as the second working mode for the electronic cigarette, and the indication information corresponding to the second working mode is provided.

Embodiment 3: a gyroscope (not shown in FIG. 3 and FIG. 4) is further disposed in the electronic cigarette, and when the mode switching signal is received by the electronic cigarette, detecting a movement track of the electronic cigarette within a predetermined time using the gyroscope; and switching between the working modes of the electronic cigarette according to the movement track.

Specifically, the technician presets a startup mode for each working mode of the electronic cigarette. For example, the startup mode for the automatic mode may be the electronic cigarette being rotated for one circle and the electronic cigarette being swayed twice; the startup mode for the manual mode may be the electronic cigarette being swayed three times; the startup mode for the integrated mode may be the electronic cigarette being swayed four times.

After the movement track of the electronic cigarette is acquired, a startup mode matching the movement track is determined, the working mode corresponding to the matched startup mode is acquired, and the working mode of the electronic cigarette is controlled to switch to the working mode corresponding to the startup mode.

Optionally, the working mode switched according to the movement track is further determined as the second working mode for the electronic cigarette, and the indication information corresponding to the second working mode is provided.

Step 1002 or Step 1003 or Step 1004 may be performed after Step 1001 is performed.

Step 1002: When the electronic cigarette is switched to the manual mode, controlling, according to the operation signal generated when the on-off key 4 is operated, whether the atomizing device 1 in the electronic cigarette works.

The specific implementation of this step may be: when the electronic cigarette is switched to the manual mode, controlling the first power switch to be ON and OFF according to the operation signal generated when the on-off key 4 is operated.

As shown in FIG. 4, when the first power switch is OFF, the power source can supply power to the atomization device 1, so that the atomization device 1 can heat smoke liquid or smoke cartridge to generate smoke. Therefore, the first power switch is controlled to be ON and OFF by the electronic cigarette according to the operation signal generated when the on-off key 4 is operated, thereby realizing the manual cigarette lighting.

Optionally, the processor in the electronic cigarette is electrically connected to the base electrode of a second power switch (not shown in FIG. 4), the source electrode of the second power switch is electrically connected to the power source, and the grid electrode of the second power switch is electrically connected to the airflow sensing device 15. In order to reduce power consumption of the airflow sensing device 15, when the electronic cigarette is in the manual mode, the second power switch is controlled to be ON, so that the power source stops supplying power to the airflow sensing device 15 and power consumption is reduced. When the electronic cigarette is in the automatic mode, the second power switch is controlled to be OFF, so that the power source supplies power to the airflow sensing device 15 to ensure that the airflow sensing device 15 can work normally.

Step 1003: When the electronic cigarette is switched to the automatic mode, controlling, according to information fed back by the airflow sensing device 15, whether the atomizing device 1 in the electronic cigarette works, where the information is used to indicate whether the electronic cigarette is in the suction state.

The specific implementation of this step may be: when the electronic cigarette is switched to the automatic mode, the first power switch is controlled to be ON and OFF according to the information fed back by the airflow sensing device 15.

Since the information fed back by the airflow sensing device 15 is used to indicate whether the electronic cigarette is in the suction state, the processor controls the first power switch to be ON and OFF according to the information, so that the user only needs to suck at the cigarette holder 8 to allow the atomizing device 1 to heat smoke liquid or smoke cartridge for generation of smoke, and realizing the automatic cigarette lighting.

Step 1004: When the electronic cigarette is switched to the integrated mode, controlling, according to the operation signal generated when the on-off key 4 is operated or the information fed back by the airflow sensing device 15, the first power switch to be ON and OFF.

Optionally, when the electronic cigarette is in the integrated mode, the second power switch is controlled to be OFF, so that the power source supplies power to the airflow sensing device 15 to ensure that the airflow sensing device 15 can work normally.

The foregoing embodiment is only described by taking an example where the working modes of the electronic cigarette include the integrated mode. In an actual implementation, the manual mode and the automatic mode may also be included, which is not limited.

In conclusion, according to the control method of the electronic cigarette provided in this embodiment, by means of switching between working modes of the electronic cigarette via software when a mode switching signal is received by the electrical cigarette; when the electronic cigarette is switched to the manual mode, controlling, according to the operation signal generated when the on-off key 4 is operated, whether the atomizing device 1 in the electronic cigarette works; when the electronic cigarette is switched to the automatic mode, controlling, according to the information detected by the airflow sensing device 15 in the electronic cigarette, whether the atomizing device 1 in the electronic cigarette works; and when the electronic cigarette is switched to the integrated mode, controlling, according to the operation signal generated when the on-off key 4 is operated or the information detected by the airflow sensing device 15, whether the atomizing device 1 in the electronic cigarette works, the problem is solved with regard to the aspect that the cigarette lighting method provided by each type of electronic cigarette in the market is single and the effect is achieved with regard to enrichment of the cigarette lighting method provided by the electronic cigarette.

In one example, the indication information corresponding to the second working mode of the electronic cigarette may be implemented in the following manners:

The first one: n indicator lights are provided on the electronic cigarette, where n is a positive integer, and an indicator light of the n indicator lights corresponding to the second working mode is controlled to light up and the other indicators to extinguish.

The indicator light corresponding to each working mode of the electronic cigarette is different from the indicator lights corresponding to other working modes. Optionally, the n indicators are not completely identical in color.

Description is made by taking an example where two indicator lights are provided on the electronic cigarette and the two indicator lights are red and green in color, respectively. The indicator light corresponding to each working mode of the electronic cigarette is shown in Table 3.

TABLE 3

| Working mode | Corresponding indicator light |
|---|---|
| Manual mode | Red indicator light |
| Automatic mode | Green indicator light |
| Integrated mode | Red indicator and green indicator light |

Description is made by taking an example where three light indicators are provided on the electronic cigarette and the three indicator lights are red, green, and orange in color, respectively. The indicator light corresponding to each working mode of the electronic cigarette is shown in Table 4.

TABLE 4

| Working mode | Corresponding indicator light |
|---|---|
| Manual mode | Red indicator light |
| Automatic mode | Green indicator light |
| Integrated mode | Orange indicator light |

The second one: each working mode of the electronic cigarette corresponds to one kind of indication information, the electronic cigarette is provided with a display screen which is connected with the processor; indication information corresponding to the second working mode may be displayed in the display screen by the electronic cigarette, where the indication information may include at least one of an icon and a text.

Figure 7:
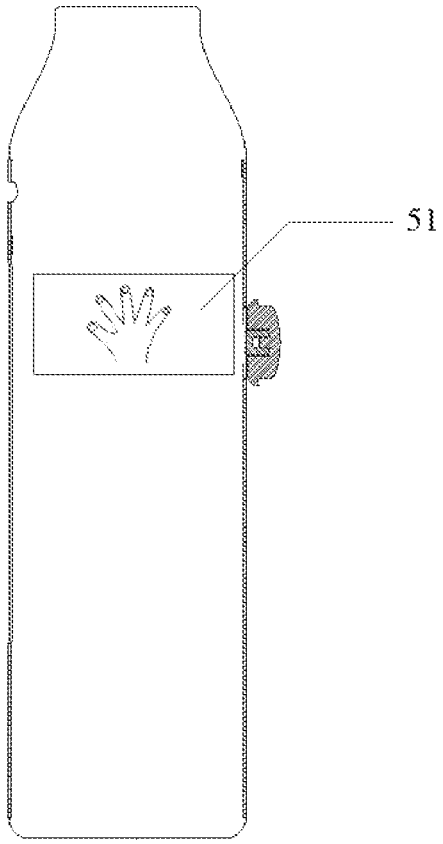
FIG. 7 is a schematic diagram of a manual mode corresponding to prompt information provided by an electronic cigarette according to another embodiment of the present disclosure.
Figure 8:
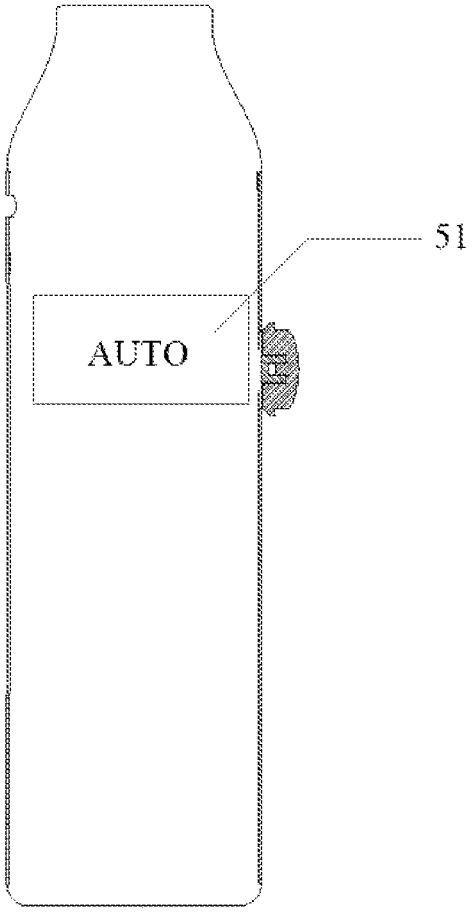
FIG. 8 is a schematic diagram of an automatic mode corresponding to prompt information provided by an electronic cigarette according to another embodiment of the present disclosure.

Optionally, as shown in FIG. 7, the indication information corresponding to the manual mode and displayed on the display screen 51 may be an icon showing a hand model; as shown in FIG. 8, the indication information corresponding to the automatic mode and displayed on the display screen 51 may include the word "auto".

It should be noted that, in the case that an icon corresponding to each working mode is displayed in the display screen, the icon corresponding to the second work mode is highlighted. For example, the color of the icon corresponding to the second working mode is deepened; for another example, a special mark is added to the icon corresponding to the second working mode, and the special mark may be a box, a triangle, Ai, or the like.

The third one: each working mode of the electronic cigarette corresponds to one kind of indication information, and the electronic cigarette may broadcast the indication information corresponding to the second working mode.

Optionally, the indication information corresponding to each working mode of the electronic cigarette may be a name of the working mode.

Optionally, a speaker is provided in the electronic cigarette, and the speaker is used by the electronic cigarette to broadcast the indication information corresponding to the second working mode.

In an example, before the electronic cigarette performs the switching between the working modes of the electronic cigarette via software in Step 1001 and after the mode switching signal is received, the following step is further performed: determining whether a switch confirming condition is met; when it is determined that the switching condition is met, the step of switching between the working modes of the electronic cigarette is performed.

The switch confirming condition is set by the developer, and the switch confirming condition may be any one of the following four types: 1. the electronic cigarette does not receive a new mode switching signal within a fourth duration after receiving the mode switching signal; 2. the electronic cigarette does not receive a new mode switching signal within a fourth duration after providing the indication information corresponding to the second working mode; and 3. after providing the indication information corresponding to the second working mode, the electronic cigarette receives the operation signal generated when the on-off key 4 is operated. The switch confirming condition may also be other types, which will not be repeated herein in this embodiment.

Optionally, after the mode switching signal is received, the electronic cigarette displays inquiring information for inquiring whether to enter the second working mode, and the switch conforming condition may be reception of an operation signal for confirming to enter the second working mode, after the inquiring information is displayed by the electronic cigarette.

Optionally, the electronic cigarette may be directly shut down when the received mode switching signal reaches a preset fifth duration but does not met the switch confirming condition, where the fifth duration is more than or equal to the fourth duration.

According to an embodiment of the present disclosure, a computer readable storage medium is further provided, one or more instructions are stored in the computer readable storage medium, the control method of the electronic cigarette according to any of the above embodiments is achieved when the one or more instructions are executed by a processor in the electronic cigarette.

The electronic cigarette in the present disclosure may include a processor and a memory, where the processor is used for executing a computer program instruction to accomplish various processes and methods, and the memory is used for storing a program instruction. The processor performs the computer program to achieve the control method of the electronic cigarette according to any of the above embodiments.

It should be noted that, when the electronic cigarette is controlled by the control device provided in the above embodiments, only the division of the program devices described above is taken as an example for illustration, in an actual application, the above functions may be distributed to different program devices to complete according to needs, that is, the internal structure of the MCU is divided into different program devices to complete all or part of the functions described above. In addition, the control device and the control method provided in the foregoing embodiments are in the same concept, and specific implementation processes thereof are described detailedly in the method embodiments, and will not be described herein again.

The serial numbers of the embodiments of the present disclosure are merely for description, but do not represent the advantages and disadvantages of the embodiments.

A person skilled in the art can understand that all or part of the steps of the above embodiments can be completed by hardware, or may be completed by executing related hardware via a program, and the program may be stored in a computer readable storage medium. The storage medium mentioned may be a read only memory, a magnetic disk, an optical disk or the like.

The above descriptions are only the preferred embodiments of the present disclosure, and are not intended to limit the present disclosure. Any modifications, equivalent replacements, improvements or the like within the spirit and scope of the present disclosure should be included in the protection scope of the present disclosure.

What is claimed is:

1. An electronic cigarette, comprising an atomizing device and a battery for supplying electrical energy to the atomizing device, wherein the electronic cigarette further comprises an on-off key, a control board, a shielding assembly, and a sensor electrically connected to the control board, when an operation signal satisfying a preset condition is received by the control board, the shielding assembly is controlled to switch between a first state and a second state;

when the shielding assembly is in the first state, the sensor is in a failure state, and a circuit between the battery and the atomizing device is controlled to be ON and OFF by the control board according to an operation signal generated when the on-off key is operated;

when the shielding assembly is in the second state, the operation signal generated when the on-off key is operated is not received by the control board, and the circuit between the battery and the atomizing device is controlled to be ON and OFF by the control board according to information detected by the sensor, wherein the information detected by the sensor is used to indicate whether the electronic cigarette is in a suction state;

wherein the shielding assembly is a shielding plate which is disposed between the sensor and the on-off key, and wherein the electronic cigarette further comprises a motor mechanically connected to the shielding plate, and the motor is electrically connected to the control board;

when the operation signal satisfying the preset condition is received by the control board, the motor is controlled to rotate to drive the shielding plate to switch between the first state and the second state.

2. The electronic cigarette according to claim 1, wherein the electronic cigarette further comprises a cigarette holder and a connecting member, and the connecting member is provided with an air inlet passage in communication with the cigarette holder, when the shielding plate is in the second state, the sensor is capable of detecting airflow within the air inlet passage.

3. The electronic cigarette according to claim 1, wherein the electronic cigarette further comprises a cigarette holder and a connecting member, and the connecting member is provided with an air inlet passage in communication with the cigarette holder, when the shielding plate is in the first state, the shielding plate blocks all or part of air around the sensor from flowing in the air inlet passage.

4. The electronic cigarette according to claim 3, wherein the shielding plate abuts against the on-off key when the shielding plate is in the second state.

5. The electronic cigarette according to claim 1, wherein the control board is further configured to control a circuit between the sensor and the battery to function as an open circuit and the shielding plate not to abut against the on-off key when the shielding plate is in the first state; and the control board is further configured to control the circuit between the sensor and the battery to function as a close circuit and the shielding plate to abut against the on-off key when the shielding plate is in the second state.

6. The electronic cigarette according to claim 1, wherein, the control board is further configured to control a circuit between the on-off key and the control board to function as a close circuit and the shielding plate to block all or part of air around the sensor from flowing in an air inlet passage when the shielding plate is in the first state; and the control board is further configured to control the circuit between the on-off key and the control board to function as an open circuit and the shielding plate not to block air around the sensor from flowing in the air inlet passage when the shielding plate is in the second state.

7. The electronic cigarette according to claim 1, wherein the electronic cigarette further comprises a switching key which is electrically connected to the control board and is disposed on a casing of the electronic cigarette, and the operation signal generated when the switching key is operated satisfies the preset condition.

8. The electronic cigarette according to claim 1, wherein an indicator light is further disposed on a casing of the electronic cigarette, the control board is further configured to control the indicator light to light up in a first color when the shielding assembly is in the first state.

9. The electronic cigarette according to claim 1, wherein an indicator light is further disposed on a casing of the electronic cigarette, the control board is further configured to control the indicator light to light up in a second color or control the indicator light to be extinguished when the shielding assembly is in the second state.

* * * * *